United States Patent [19]

Santasalo

[11] Patent Number: 5,022,215

[45] Date of Patent: Jun. 11, 1991

[54] METHOD AND APPARATUS FOR STORING AND TRANSPORTING A SOLUTION OF PERACETIC ACID

[75] Inventor: Lauri Santasalo, Helsinki, Finland

[73] Assignee: Sterilinja Oy, Finland

[21] Appl. No.: 518,783

[22] Filed: May 4, 1990

[30] Foreign Application Priority Data

May 5, 1989 [FI] Finland ..... 892166

[51] Int. Cl.[5] ..... B65B 7/28; B65B 61/02; B65B 5/06; B67B 3/00

[52] U.S. Cl. ..... 53/420; 53/449; 53/471; 53/487

[58] Field of Search ..... 53/471, 487, 486, 492, 53/489, 290, 320, 381 R, 410, 420, 432, 449; 426/118, 395

[56] References Cited

U.S. PATENT DOCUMENTS

| | | | |
|---|---|---|---|
| 291,458 | 1/1884 | Worden et al. | 53/320 |
| 1,302,189 | 4/1919 | McColl et al. | 53/471 X |
| 1,607,626 | 11/1926 | Hopkinson | 53/486 X |
| 1,792,010 | 2/1931 | Goss | 53/471 X |
| 1,904,741 | 4/1933 | Lorber | 426/118 X |
| 2,997,397 | 8/1961 | Doulgheridis | 53/432 X |
| 3,387,765 | 6/1968 | Davis | 426/118 X |
| 3,484,015 | 12/1969 | Rowan | 426/118 X |
| 3,733,771 | 5/1973 | Megowen | 53/471 |
| 4,011,119 | 3/1977 | Mitchell et al. | 53/487 X |
| 4,817,815 | 4/1989 | Stahlecker | 53/489 X |
| 4,902,521 | 2/1990 | Rosenfeld | 426/118 X |

*Primary Examiner*—Horace M. Culver
*Attorney, Agent, or Firm*—Steinberg & Raskin

[57] ABSTRACT

The invention is concerned with a method of storing and transporting a solution of peracetic acid or a solution with similar properties. In the system the solution of peracetic acid or the like is poured in one or more containers (1) in the plug (4) of which there is made a microscopic hole (5), which bottles (1) are then sealed in a closed vessel (6) of flexible and non-corrodible material, the cover of which becomes loose when too high a pressure is formed inside the vessel (6) and which cover (7) can be sealed again by pressing it closely when the pressure has been released from the vessel.

3 Claims, 1 Drawing Sheet

METHOD AND APPARATUS FOR STORING AND TRANSPORTING A SOLUTION OF PERACETIC ACID

BACKGROUND OF THE INVENTION

The invention is concerned with a method and apparatus for storing and transporting a solution of peracetic acid or a solution with corresponding properties.

In industry and elsewhere, solutions of peracetic acid are frequently needed and among other uses, it is presently used for the sterilizing of objects, e.g., in a manner according to the Applicant's FI patent application Ser. Nos. 874366 and 890551.

Since peracetic acid slowly decomposes, it must be stored so that it can not escape from its storage vessel but then a gaseous pressure is formed in its storage vessel during transport and stationary storage which is difficult to control.

The aforementioned troublesome storage and transport of peracetic acid has thus become a hindrance for its used because peracetic acid can also be an explosive material which is the reason that there are special provisions for the transport and storing of it which must be attended to. Mixtures containing peracetic acid must be packed in a vessel of glass or suitable plastic in maximum batches of 25 kg. There must also be an opening in the sealing device above the liquid surface, such that the inner gas pressure and the outer ambient pressure can be equalized. The special provisions are explained in the publication; (Extract: Vaarallisten aineiden kuljetus tiellä, 1980 / Transl: Transporting dangerous material on streets, 1980). In practice such transport has been carried out either by land or by water.

SUMMARY OF THE INVENTION

The object of this invention is a simple and safe transporting system for peracetic acid by means of which a solution of peracetic acid can be safely transported and stored.

To achieve this object, the method of the invention for transporting and storing a solution of peracetic acid or the like comprises steps wherein the solution of peracetic acid or the like is poured into one or more containers, which can be bottles, in the closure plugs of which there is made a microscopic hole, which containers are then sealed in a closed vessel of flexible and non-corrodible material, the closure cover of which becomes loose when a predetermined gas pressure is reached inside the vessel and which cover can be sealed again by pressing it tightly when the internal pressure has been released.

The storing and transporting apparatus of the invention for a solution of peracetic acid comprises a vessel of flexible and non-corrodible material. It also comprises one or more containers within the vessel containing solutions of peracetic acid or the like, in the closure plugs of which there is a microscopic hole and wherein the cover of the vessel of flexible material becomes loose when too high a predetermined gas pressure is reached inside the vessel.

Even if an inhibitor has been added to solutions of peracetic acid because of the ignition and explosion risk, there is no risk of explosion in the transporting system of the invention because there is a microscopic hole in the plug of the containers containing the solution of peracetic acid, through which hole the overpressure gas, but not the solution itself, can emerge into the transport vessel. When a gas pressure high enough is formed inside the vessel inside of which are the containers filled with peracetic acid, the cover of the vessel becomes loose and the gas can escape before any risk of explosion. The cover of the vessel can then easily be closed again tightly.

The containers with peracetic acid can contain e.g., from one deci-liter to one liter of solution, and they can be composed of e.g., bottles of glass or plastic which are filled in a manner such that a gas pressure space is left therein. They can be placed in a stand in a plastic vessel so that they cannot slide within the vessel. The material of the plastic vessel can be any soft commercial plastic.

DESCRIPTION OF THE PREFERRED EMBODIMENTS

Figure 2:
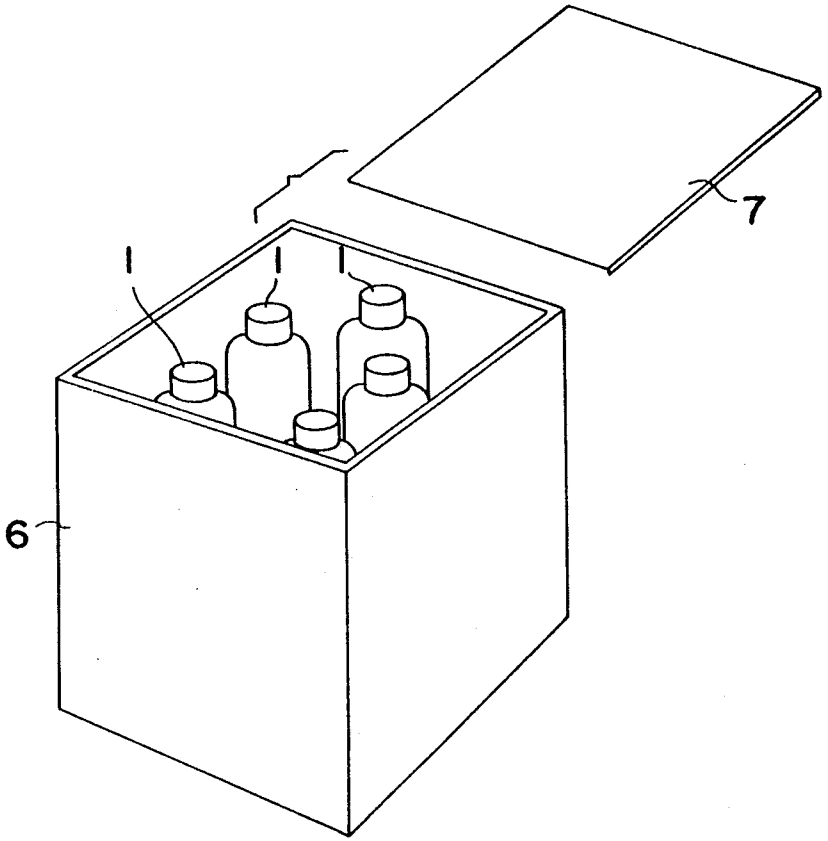
FIG. 2 is a perspective view of a storage vessel containing several containers of the type shown in FIG. 1.
Figure 1:
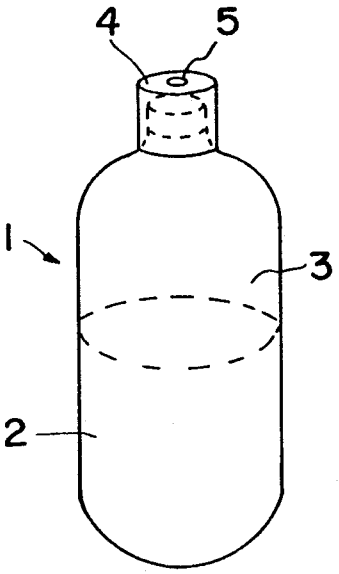
FIG. 1 is a perspective view of a container which can be used to store and transport peracetic acid in a preferred embodiment of the invention.

In FIG. 1, there is shown a container 1, that is filled with a suitable amount of peracetic acid 2 so that a sufficient gas pressure space 3 is left in the container. The plug 4 of the container has a microscopic hole 5 therein, which hole is carried out e.g., with a laser or a tool with a small boring element so that the gaseous overpressure due to the evaporation of the peracetic acid in the bottle 1 can escape but substantial amounts of the solution itself can't escape therefrom. The bottle 1 or several bottles, advantageously at least two, is placed e.g., by means of a stand, in a vessel 6 of non-corrodible and flexible material so that bottles are not movable relative to the vessel during transport. The vessel 6 is sealed for storing and transporting by means of a cover 7 which is impermeable to air but which becomes loose when the gas pressure inside the vessel 6 has reached a predetermined gas level. The cover 7 can thereupon be easily put back in place.

The invention thus presents an excellent solution for the storage and transport problems of peracetic acid in that it is safe, simple and economical to carry out. As compared with the methods of the prior art, the bottles in the transport systems of the invention are much easier to handle because relatively small bottles are used together with a relatively large protective vessel. Furthermore, it should be noted that the invention is not restricted to be used only in connection with solutions of peracetic acid but can be used as well for the transport of other materials that decompose slowly.

Details of the present invention may easily vary within the scope of the inventive concepts set forth above, which have been presented by way of example only. Therefore, the preceding description of the present invention is merely exemplary, and is not intended to limit the scope thereof in any way.

What is claimed is:

1. A method of storing, in a manner suitable for transport, solutions of peracetic acid or solutions with similar properties, said method comprising the steps of:

filling one or more open containers with said peracetic acid;

closing the respective openings of said containers with respective plugs;

boring a microscopic hole in said respective plugs such that gas formed by decomposition of said peracetic acid can escape from said container;

placing said one or more containers having been filled with peracetic acid and closed with said respective plugs having said microscopic holes bored therein into an open vessel; and closing said vessel with a cover which opens when a predetermined gaseous pressure within said vessel has been reached.

2. The method of claim 1, wherein said boring step comprises using a laser to bore said microscopic hole in said respective plugs.

3. The method of claim 1, wherein said boring step comprises using a tool with a small boring element to bore said microscopic hole in said respective plug.

* * * * *